US008922571B2

(12) United States Patent
Tripathi et al.

(10) Patent No.: US 8,922,571 B2
(45) Date of Patent: Dec. 30, 2014

(54) DISPLAY PIPE REQUEST AGGREGATION

(75) Inventors: Brijesh Tripathi, Los Altos, CA (US); Peter F. Holland, Los Gatos, CA (US); Shing Horng Choo, San Francisco, CA (US); Steven T. Peltier, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 190 days.

(21) Appl. No.: 13/610,620

(22) Filed: Sep. 11, 2012

(65) Prior Publication Data

US 2014/0071140 A1 Mar. 13, 2014

(51) Int. Cl.
*G09G 5/39* (2006.01)

(52) U.S. Cl.
USPC ..... 345/531; 345/204; 345/506; 345/535; 345/541; 345/545; 345/547

(58) Field of Classification Search
CPC ..... G06F 13/1663; G06T 1/20
USPC ..... 345/506, 531, 541, 204, 535, 545, 547
See application file for complete search history.

(56) References Cited

U.S. PATENT DOCUMENTS

| | | | | |
|---|---|---|---|---|
| 4,811,205 | A * | 3/1989 | Normington et al. | 345/502 |
| 6,005,546 | A * | 12/1999 | Keene | 345/603 |
| 7,127,573 | B1 | 10/2006 | Strongin et al. | |
| 7,617,344 | B2 | 11/2009 | Nozaki et al. | |
| 7,925,804 | B2 | 4/2011 | Nara | |
| 8,180,963 | B2 | 5/2012 | Conte et al. | |
| 8,180,975 | B2 | 5/2012 | Moscibroda et al. | |
| 2006/0044328 | A1* | 3/2006 | Rai et al. | 345/629 |
| 2008/0252647 | A1* | 10/2008 | Rai et al. | 345/520 |
| 2008/0297525 | A1* | 12/2008 | Rai | 345/534 |
| 2012/0072679 | A1* | 3/2012 | Biswas et al. | 711/154 |
| 2013/0033510 | A1* | 2/2013 | Dou et al. | 345/531 |

* cited by examiner

*Primary Examiner* — Maurice L McDowell, Jr.
(74) *Attorney, Agent, or Firm* — Rory D. Rankin; Meyertons, Hood, Kivlin, Kowert & Goetzel, P.C.

(57) ABSTRACT

A system and method for efficiently scheduling memory access requests. A semiconductor chip includes a memory controller for controlling accesses to a shared memory and a display controller for processing frame data. In response to detecting an idle state for the system and the supported one or more displays, the display controller aggregates memory requests for a given display pipeline of one or more display pipelines prior to attempting to send any memory requests from the given display pipeline to the memory controller. Arbitration may be performed while the given display pipeline sends the aggregated memory requests. In response to not receiving memory access requests from the functional blocks or the display controller, the memory controller may transition to a low-power mode.

27 Claims, 6 Drawing Sheets

DISPLAY PIPE REQUEST AGGREGATION

BACKGROUND OF THE INVENTION

1. Field of the Invention

This invention relates to semiconductor chips, and more particularly, to efficiently scheduling memory access requests.

2. Description of the Relevant Art

A semiconductor chip may include multiple functional blocks or units, each capable of accessing a shared memory. In some embodiments, the multiple functional units are individual dies on an integrated circuit (IC), such as a system-on-a-chip (SOC). In other embodiments, the multiple functional units are individual dies within a package, such as a multi-chip module (MCM). In yet other embodiments, the multiple functional units are individual dies or chips on a printed circuit board. A memory controller may control access to the shared memory.

The multiple functional units on the chip are sources for memory access requests sent to the memory controller. Additionally, one or more functional units may include multiple sources for memory access requests to send to the memory controller. For example, a video subsystem in a computing system may include multiple sources for video data. The design of a smartphone or computer tablet may include user interface layers, cameras, and video sources such as media players. Each of these sources may utilize video data stored in memory. A corresponding display controller may include multiple internal pixel-processing pipelines for these sources.

Each request sent from one of the multiple sources includes both overhead processing and information retrieval processing. A large number of requests from separate sources of the multiple sources on the chip may create a bottleneck in the memory subsystem. The repeated overhead processing may reduce the subsystem performance.

A burst mode or bursting feature may be used to reduce the number of individual requests from separate sources. The burst mode allows a given source of the multiple sources to gain control of a bus or buses within a high-level interconnect, and send a programmable number of requests to the memory controller without being interrupted by another source. The given source may repeatedly send the requests without waiting for an acknowledgment from another device, such as the memory controller. An arbitration process may be used to select the given source. Arbitration may not occur again until the given source finished sending its programmable number of requests.

The bursting feature may prevent particular areas of the chip from entering a low-power mode. For example, the refresh rate of a display screen may be 60 frames-per-second, so a user reading search results during browsing may cause long pauses to updates on the display screen. Many areas of a corresponding chip may be inactive while the display screen is idle. However, the memory subsystem may not be able to enter a low-power mode as one or more display pipelines continue to access the shared memory. The shared memory may be off-die synchronous dynamic random access memory (SDRAM) used to store frame data in frame buffers. The accesses of the SDRAM consume an appreciable amount of power in addition to preventing the memory subsystem from entering a low-power mode.

In view of the above, methods and mechanisms for efficiently scheduling memory access requests are desired.

SUMMARY OF EMBODIMENTS

Systems and methods for efficiently scheduling memory access requests are contemplated. In various embodiments, a semiconductor chip includes a memory controller and a display controller. The memory controller may control accesses to a shared memory, such as an external memory located off of the semiconductor chip. The display controller may include one or more internal pixel-processing pipelines. Each of the pixel-processing pipelines may be able to process the frame data received from the memory controller for a respective video source.

A frame may be processed by the display controller and presented on a respective display screen. During processing, control logic within the display controller may send multiple memory access requests to the memory controller. In response to detecting an idle display for each supported and connected display, the display controller aggregates a number of memory requests for a given display pipeline of the one or more display pipelines prior to attempting to send any memory requests from the given display pipeline to the memory controller. The number of memory requests to aggregate may be a programmable value. The display controller may receive an indication that functional blocks on the semiconductor chip do not access the shared memory. The indication may act as a further qualification to begin aggregating memory requests. In response to not receiving memory access requests from the functional blocks or the display controller, the memory controller may transition to a low-power mode.

These and other embodiments will be further appreciated upon reference to the following description and drawings.

Figure 1:
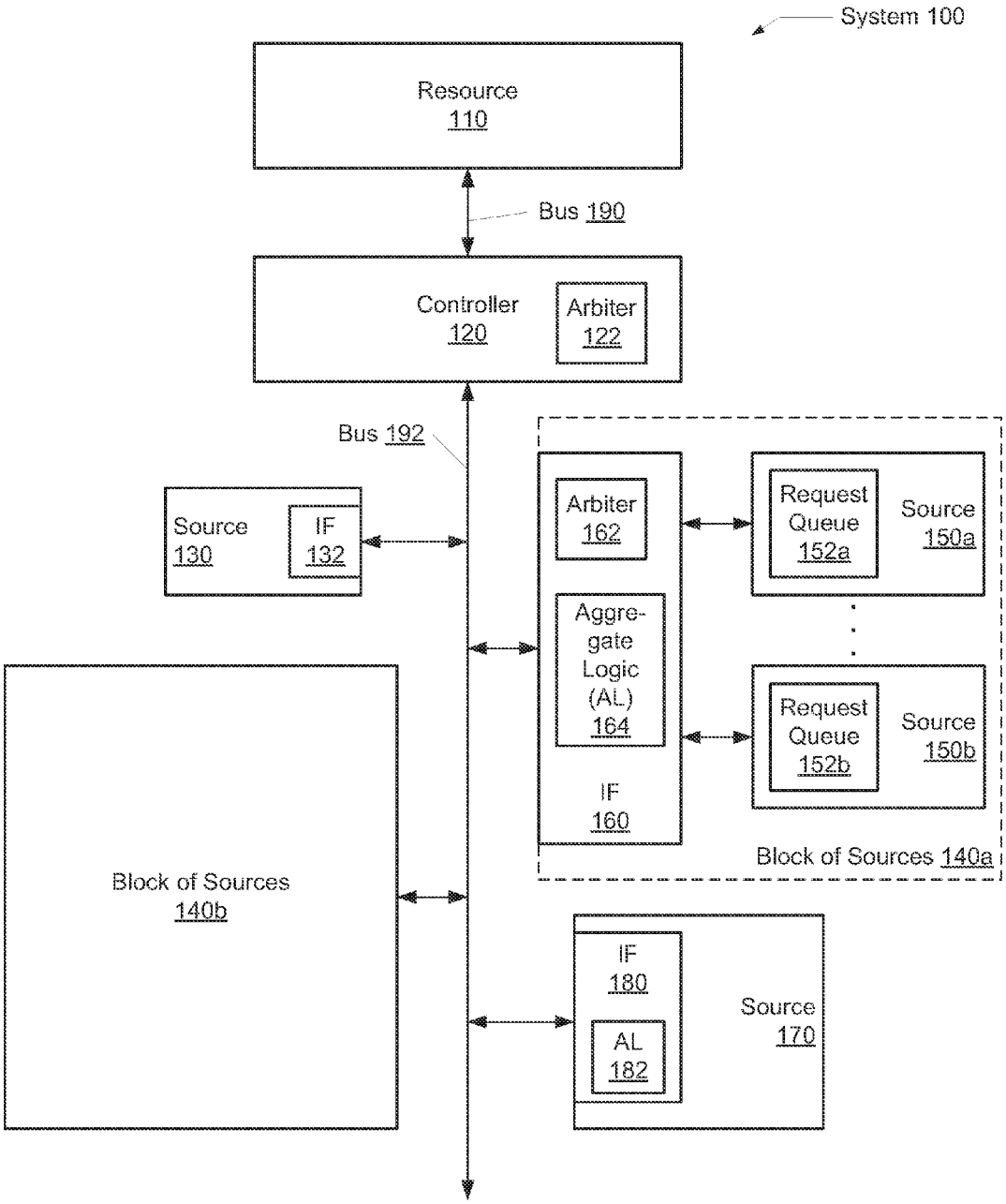
FIG. 1 is a generalized block diagram of one embodiment of a system with control of shared resource access traffic.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims. As used throughout this application, the word "may" is used in a permissive sense (i.e., meaning having the potential to), rather than the mandatory sense (i.e., meaning must). Similarly, the words "include," "including," and "includes" mean including, but not limited to.

Various units, circuits, or other components may be described as "configured to" perform a task or tasks. In such contexts, "configured to" is a broad recitation of structure generally meaning "having circuitry that" performs the task or tasks during operation. As such, the unit/circuit/component can be configured to perform the task even when the unit/circuit/component is not currently on. In general, the circuitry that forms the structure corresponding to "configured to" may include hardware circuits. Similarly, various units/circuits/components may be described as performing a task or tasks, for convenience in the description. Such descriptions should be interpreted as including the phrase "configured to." Reciting a unit/circuit/component that is configured to perform one or more tasks is expressly intended not to invoke 35 U.S.C. §112, paragraph six, interpretation for that unit/circuit/component.

DETAILED DESCRIPTION

In the following description, numerous specific details are set forth to provide a thorough understanding of the present invention. However, one having ordinary skill in the art should recognize that the invention might be practiced without these specific details. In some instances, well-known circuits, structures, and techniques have not been shown in detail to avoid obscuring the present invention.

Referring to FIG. 1, a generalized block diagram of one embodiment of a system 100 with control of shared resource access traffic is shown. As shown, a controller 120 provides controlled access to a shared resource 110. In some embodiments, the resource 110 is a shared memory and the controller 120 is a memory controller. In other examples, the shared resource 110 may be a complex arithmetic unit or a network switching fabric. Other examples of a resource and its associated controller are possible and contemplated. The controller 120 may receive requests that access the resource 110 from multiple sources, such as sources 130 and 170 and the block of sources 140*a*-140*b*. The sources may also be referred to as requesters.

The system 100 may include a hybrid arbitration scheme wherein the controller 120 includes a centralized arbiter 122 and one or more of the sources include distributed arbitration logic. For example, each one of the blocks of sources 140*a*-140*b* may include an arbiter. The block of sources 140*a* includes arbiter 162 for selecting a given request to place on the bus 192 from multiple requests generated by the sources 150*a*-150*b*. The arbiter 122 within the controller 120 may select a given request to place on the bus 190 from multiple requests received from the sources 130 and 170 and the block of sources 140*a*-140*b*. The arbitration logic used by at least the arbiters 122 and 162 may include any type of request traffic control scheme. For example, a round robin, a least-recently-used, an encoded priority, and other schemes may be used.

Each of the sources 130 and 170 and the block of sources 140*a*-140*b* may include interface logic to connect to the bus 192. For example, the source 130 includes interface (IF) 132, the source 170 includes IF 180, and the block of sources 140*a* includes IF 160. A given protocol may be used by the interface logic dependent on the bus 192. In some examples, the bus 192 may also be a switch fabric. Each of the sources in the system 100 may store generated requests for the shared resource 110. A request queue may be used for the storage. The sources 150*a*-150*b* include request queues and response data buffers 152*a*-152*b* for storing generated requests for the shared resource 110 and storing corresponding response data. Although not shown, other sources within the system 100 may include request queues and response data buffers. Alternatively, a respective request queue and a respective response data buffer may be located within an associated interface.

One or more of the sources in the system 100 may include request aggregate logic. An associated source generates requests for the shared resource 110 and stores the requests in a request queue. However, in various embodiments, the associated response data buffer may first deallocate a sufficient number of entries to store the response data before the read requests are generated and stored in the request queue. The source may not be a candidate for arbitration, and additionally, read requests may not be generated until sufficient storage space is available in the response data buffer. The sufficient amount of storage space may be measured as a number of generated read requests. For example, each read request may retrieve a given amount of data, such as 64 bytes. Therefore, the amount of available space to free in the response data buffer may be divided by the 64-byte size to convert to a number of read requests. A count may be performed as space is made available in the response data buffer. The source may not be a candidate for arbitration until the counted number of read requests to generate reaches a given threshold. The given threshold may be a programmable number stored in a configuration register.

The block of sources 140*a* includes aggregate logic (AL) 154*a* for source 150*a* and aggregate logic (AL) 154*b* for source 150*b*. The source 170 includes AL 184. Until the given threshold is reached, no read requests may be generated and stored in a corresponding read queue. The arbiter 162 may not use a given one of the sources 150*a*-150*b* as a candidate for selecting requests to send to the controller 120. Similarly, until a given threshold is reached, the source 170 may not send any requests or an indication as a candidate for arbitration to the controller 120.

In some embodiments, the aggregate logic is not used or enabled until an aggregate condition is satisfied. For example, the system 100 may be operating in a mode wherein only a single source or a single block of sources is still generating requests for the shared resource 110. For example, the block of sources 140*a* may be a display controller. The system 100 may be in an idle state, wherein a user of the system 100 is not executing any applications. The user may be away from a corresponding device using the system 100. Alternatively, the user may be reading browsing search results. No functional block may be accessing a shared memory in this idle state except for the display controller. Any active display connected to the system 100 may be idle.

The memory accesses by the display controller may prevent the shared memory from transitioning to a low-power mode. However, in response to determining the idle state, the display controller may aggregate a relatively large amount of storage space for response data prior to generating memory read requests before becoming a candidate for arbitration. A relatively large number of memory read requests may be generated afterward, which eventually causes the display controller to become a candidate for arbitration and a source of memory read requests when selected. As a result, the shared memory may not be accessed for a relatively large amount of time as no other functional blocks are accessing the shared memory during the idle time. Therefore, the shared memory may spend longer amounts of time in a low-power mode causing an overall reduction in power consumption.

Similar to the block of sources 140*a*, which includes multiple sources 150*a*-150*b*, the display controller may include multiple sources or requesters for memory accesses. For example, the display controller may include multiple display pipelines, each associated with a separate display screen. In addition, each display pipeline may include multiple requesters, such as separate layers or sources for video data. Examples may include user interface (UI) layers and video layers, such as multimedia players.

A source among the sources 140*a*-140*b* and the source 170 may send queued memory read requests uninterrupted to the shared resource 110 through the controller 120, in response to: the source is in an aggregate mode, the selected source reaches the given threshold of a number of queued requests, and the source is selected by arbitration logic. In various embodiments, no arbitration may occur while the selected source sends its queued requests. In some embodiments, the selected source may send a request that is generated after winning arbitration and before sending a last request stored in the request queue.

Figure 2:
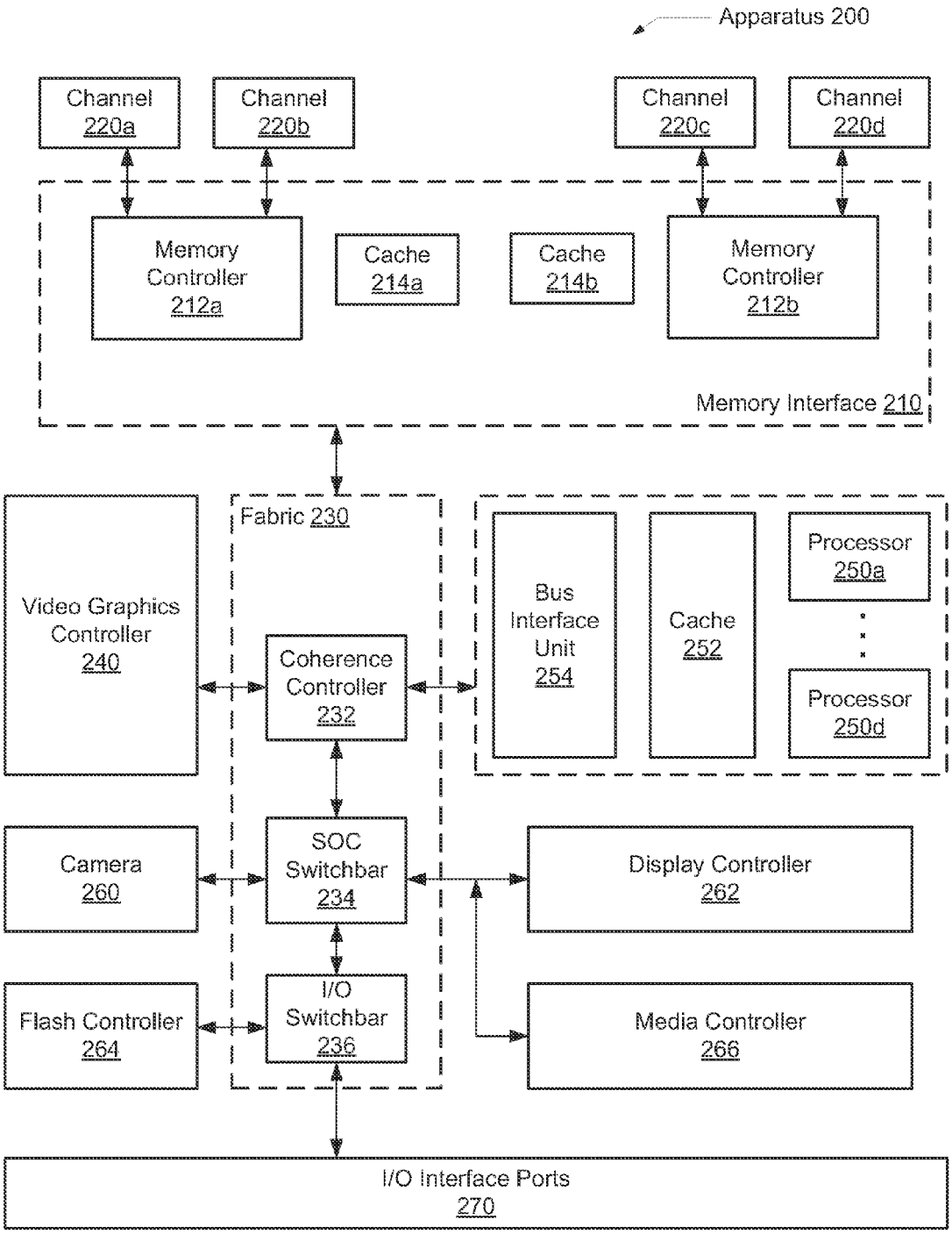
FIG. 2 is a generalized block diagram of one embodiment of an apparatus capable of aggregating requests for a shared resource.

Referring to FIG. 2, a generalized block diagram illustrating one embodiment of an apparatus 200 capable of aggregating requests for a shared resource is shown. The apparatus 200 includes multiple functional blocks or units. In some embodiments, the multiple functional units are individual dies on an integrated circuit (IC), such as a system-on-a-chip (SOC). In other embodiments, the multiple functional units are individual dies within a package, such as a multi-chip module (MCM). In yet other embodiments, the multiple functional units are individual dies or chips on a printed circuit board. The multiple functional blocks or units may each be capable of accessing a shared memory.

In various embodiments, the apparatus 200 is a SOC that includes multiple types of IC designs on a single semiconductor die, wherein each IC design provides a separate functionality. The IC designs on the apparatus 200 may also be referred to as functional blocks on the apparatus 200. Traditionally, each one of the types of IC designs, or functional blocks, may have been manufactured on a separate silicon wafer. In the illustrated embodiment, the apparatus 200 includes multiple IC designs; a fabric 230 for high-level interconnects and chip communication, a memory interface 210, and various input/output (I/O) interfaces 270. Clock sources, such as phase lock loops (PLLs), and a centralized control block for at least power management are not shown for ease of illustration.

The multiple IC designs within the apparatus 200 may include various analog, digital, mixed-signal and radio-frequency (RF) blocks. For example, the apparatus 200 may include one or more processors 250*a*-250*d* with a supporting cache hierarchy that includes at least cache 252. In some embodiments, the cache 252 may be a shared level two (L2) cache for the processors 250*a*-250*d*. In addition, the multiple IC designs may include a display controller 260, a flash memory controller 264, and a media controller 266. Further, the multiple IC designs may include a video graphics controller 240 and one or more processing blocks associated with real-time memory performance for display and camera subsystems, such as camera 260.

Any real-time memory peripheral processing blocks may include image blender capability and other camera image processing capabilities as is well known in the art. The apparatus 200 may group processing blocks associated with non-real-time memory performance, such as the media controller 266, for image scaling, rotating, and color space conversion, accelerated video decoding for encoded movies, audio processing and so forth. The units 260 and 266 may include analog and digital encoders, decoders, and other signal processing blocks. In other embodiments, the apparatus 200 may include other types of processing blocks in addition to or in place of the blocks shown.

In various embodiments, the fabric 230 provides a top-level interconnect for the apparatus 200. For example, connections to the cache coherence controller 232 may exist for various requestors within the apparatus 200. A requestor may be one of the multiple IC designs on the apparatus 200. The cache coherence controller 232 may provide to the multiple IC designs a consistent data value for a given data block in the shared memory, such as off-chip dynamic random access memory (DRAM). The coherence controller 232 may use a cache coherency protocol for memory accesses to and from the memory interface 210 and one or more caches in the multiple IC designs on the apparatus 200. An example of a cache coherency protocol includes the MOESI protocol with the Modified (M), Owned (O), Exclusive (E), Shared (S), and Invalid (I) states.

In some embodiments, one requestor connection to the coherence controller 232 may be provided for one or more graphics processing units (GPUs) within the video graphics controller 240, one requestor connection for the processor cores 250*a*-250*d*, and one request connection for the remainder of the multiple IC designs and the I/O interface ports 270 on the apparatus 200. The SOC switchbar 234 may be used to aggregate traffic from these remaining multiple IC designs.

In various embodiments, different types of traffic may flow independently through the fabric 230. The independent flow may be accomplished by allowing a single physical fabric bus to include a number of overlaying virtual channels, or dedicated source and destination buffers, each carrying a different type of traffic. Each channel may be independently flow controlled with no dependence between transactions in different channels.

The memory interface 210 may include one or more memory controllers and one or more memory caches for the off-chip memory, such as synchronous DRAM (SDRAM). The memory caches may be used to reduce the demands on memory bandwidth and average power consumption. In various embodiments, the memory interface 210 includes memory controllers 212*a*-212*b* and memory caches 214*a*-214*b*. In some embodiments, bus traffic may be routed through two symmetric bus classes, such as a left bus class and a right bus class. Therefore, two memory controllers 212*a*-212*b* and two memory caches 214*a*-214*b* may be used. Although two memory controllers 212*a*-212*b* and two caches 214*a*-214*b* are shown, in various other embodiments a single memory controller and a single memory cache may be used.

As shown, in some embodiments, the memory controllers 212*a*-212*b* may not be a coherency point within the apparatus 200 as they are separate from the coherence controller 232. This separation may allow an associated system level memory cache, such as caches 214*a*-214*b*, to be inserted in the path to memory. The memory caches 214*a*-214*b* may be logically located between the coherence controller 232 and the memory controllers 212*a*-212*b*. Additionally, the memory caches 214*a*-214*b* may not participate in a cache coherency protocol. In other embodiments, the memory interface 210 may include a directory-based coherency protocol causing the coherency point may be located within the memory interface 210. In such embodiments, the memory caches 214*a*-214*b* may participate in the cache coherency protocol.

The memory caches 214*a*-214*b* may be used by each one of the multiple IC designs on the apparatus 200. The allocation policy for the memory caches 214*a*-214*b* may be programmable. The memory caches 214*a*-214*b* may also be used in a synchronous RAM (SRAM) mode for system boot and system debug. One or more memory channels 220*a*-220*d* may be connected to the memory interface 210.

The caches 214*a*-214*b* may store one or more blocks, each of which is a copy of data stored at a corresponding address in the system memory. As used herein, a "block" is a set of bytes stored in contiguous memory locations, which are treated as a unit for coherency purposes although the caches 214*a*-214*b* may not participate in the cache coherency protocol. As used herein, the terms "cache block", "block", "cache line", and "line" are interchangeable. The number of bytes in a block may be varied according to design choice, and may be of any size. As an example, 64 byte blocks may be used.

Each of the memory channels 220*a*-220*d* may be a separate interface to a memory, such as SDRAM. The memory controllers 212*a*-212*b* may include request queues for queuing memory requests. The memory controllers 212*a*-212*b* may also include logic for supporting a given protocol used to interface to the memory channels 220-220*d*. The protocol may determine values used for information transfer, such as a number of data transfers per clock cycle, signal voltage levels, signal timings, signal and clock phases and clock frequencies. Protocol examples include DDR2 (Double Data Rate, version 2) SDRAM, DDR3 SDRAM, GDDR4 (Graphics Double Data Rate, version 4) SDRAM, and GDDR5 (Graphics Double Data Rate, version 5) SDRAM.

The interface between the combination of the memory interface 210 and the coherency controller 232 and the remainder of the apparatus 200, which includes the multiple IC designs and the switch bars 234 and 236, includes multiple buses. Asynchronous memory requests, responses, snoops, snoop responses, and input/output (I/O) transactions are visible at this interface with temporal relationships.

The display controller 262 sends graphics output information that was rendered to one or more display devices. The rendering of the information may be performed by the display controller 262, by the video graphics controller 240, or by both controllers 262 and 240. Alternatively, the display controller 262 may send graphics output information to the video graphics controller 240 to be output to one or more display devices. The graphics output information may correspond to frame buffers accessed via a memory mapping to the memory space of a GPU within the video graphics controller 240. The memory mappings may be stored and updated in address translators. The frame data may be for an image to be presented on a display. The frame data may include at least color values for each pixel on the screen. The frame data may be read from the frame buffers stored in the off-die SDRAM or the on-die caches 214*a*-214*b*.

The display controller 262 may include one or more display pipelines. Each display pipeline may send rendered graphical information to a separate display. For example, a display panel internal to a computing device that includes the apparatus 200 may be used. Additionally, a network-connected display may also be supported. Each display pipeline within the display controller 262 associated with a separate display screen may include one or more internal pixel-processing pipelines. A further description of the internal pixel-processing pipelines is provided later.

Each of the internal pixel-processing pipelines within the one or more display pipelines may independently and simultaneously access respective frame buffers stored in memory. Although the caches 214*a*-214*b* may reduce the average latency of memory access requests, an entire frame buffer does not fit within any one of the caches 214*a*-214*b*. Therefore, the off-die memory is additionally accessed. The off-die memory is accessed even during idle states.

In one example, a user reading search results during browsing may cause long pauses to updates on a given display screen. Many, if not all, of the IC devices on the apparatus 200 outside of the display controller 262 may be inactive while one or more display screens are idle. Although many of the IC devices on the apparatus 200 may be able to transition to a low-power mode, the fabric 230 and the memory interface 210 may not be able to transition to a low-power mode. The refresh rate of a display screen may be 60 frames-per-second. One or more of the display pipelines within the display controller 262 may be sending memory access requests to the memory interface 210 for video frame data during the idle pauses in user activity. The accesses of the off-die SDRAM consume an appreciable amount of power in addition to preventing the memory interface 210 from entering a low-power mode.

The display controller 262 may include an arbiter for selecting a given request to send to the memory interface 210 through the fabric 230. The selected request may be from multiple requests generated by the display pipelines within the display controller 262. Alternatively, each display pipeline may include an arbiter for selecting a given request from multiple requests generated by multiple internal pixel-processing pipelines. Memory access requests may be stored in a request queue. The display controller 262 may include request aggregate logic. Alternatively, one or more of the display pipelines within the display controller 262 may include request aggregate logic. The aggregate logic may prevent a given one of the display pipelines or a given one of the internal pixel-processing pipelines from being a candidate for arbitration. In some embodiments, a display pipeline or an internal pixel-processing pipeline may not be a candidate for arbitration until the number of stored requests reaches a given threshold. In other embodiments, the display pipeline or the internal pixel-processing pipeline may not be a candidate for arbitration until the amount of storage space for subsequent response data reaches a given threshold. The threshold may be measured as a corresponding number of memory read requests. The given threshold may be a programmable number stored in a configuration register. Until the given threshold is reached, a corresponding arbiter may not use the associated pipeline source as a candidate for selecting requests to send to the fabric 230. In some embodiments, the aggregate logic is not used until an aggregate condition is satisfied. For example, the idle pause in user activity may be one condition.

In response to determining the idle state, the display controller 262 may aggregate a relatively large number of memory access requests or a large amount of corresponding response data, depending on the implementation, before becoming a candidate for arbitration. As a result, the memory interface 210 may not be accessed for a relatively large amount of time as no other functional blocks, or IC devices, on the apparatus 200 are accessing the shared memory during the idle time. Therefore, the memory interface 210 may spend longer amounts of time in a low-power mode causing an overall reduction in power consumption. Before providing details of aggregating requests, a further description of the other components of the apparatus 200 is provided.

Each one of the processors 250*a*-250*d* may include one or more cores and one or more levels of a cache memory subsystem. Each core may support the out-of-order execution of one or more threads of a software process and include a multi-stage pipeline. Each one of the processors 250*a*-250*d* may include circuitry for executing instructions according to a predefined general-purpose instruction set. For example, the PowerPC® instruction set architecture (ISA) may be selected. Alternatively, the ARM®, x86®, x86-64®, Alpha®, MIPS®, PA-RISC®, SPARC® or any other instruction set architecture may be selected.

Generally, the processors 250*a*-250*d* may include multiple on-die levels (L1, L2, L3 and so forth) of caches for accessing data and instructions. If a requested block is not found in the on-die caches or in the off-die cache 252, then a read request for the missing block may be generated and transmitted to the memory interface 210 or to on-die flash memory (not shown) controlled by the flash controller 264. The flash memory may be a non-volatile memory block formed from an array of flash memory cells. Alternatively, the memory 250 may include other non-volatile memory technology. The bus interface unit (BIU) 254 may provide memory access requests and responses for at least the processors 250*a*-250*d*.

The processors 250*a*-250*d* may share the on-chip flash memory and the off-chip DRAM accessed through the memory interface 210 with other processing blocks, such as graphics processing units (GPUs), application specific integrated circuits (ASICs), and other types of processor cores. Therefore, typical SOC designs utilize acceleration engines, or accelerators, to efficiently coordinate memory accesses and support coherency transactions between processing blocks and peripherals. In a SOC design that includes multiple processors and processing blocks, these components communicate with each other to control access to shared resources. The coherence controller 232 in the fabric 230 may manage memory coherence.

Other processor cores on apparatus 200 may not include a mirrored silicon image of processors 250*a*-250*d*. These other processing blocks may have a micro-architecture different from the micro-architecture used by the processors 250*a*-250*d*. For example, other processors may have a micro-architecture that provides high instruction throughput for a computational intensive task, such as a single instruction multiple data (SIMD) core. Examples of SIMD cores include graphics processing units (GPUs), digital signal processing (DSP) cores, or other. For example, the video graphics controller 240 may include one or more GPUs for rendering graphics for games, user interface (UI) effects, and other applications.

The apparatus 200 may include processing blocks for real-time memory performance, such as the camera 260 and the display controller 262, as described earlier. In addition, the apparatus 200 may including processing blocks for non-real-time memory performance for image scaling, rotating, and color space conversion, accelerated video decoding for encoded movies, audio processing and so forth. The media controller 266 is one example. The I/O interface ports 270 may include interfaces well known in the art for one or more of a general-purpose I/O (GPIO), a universal serial bus (USB), a universal asynchronous receiver/transmitter (uART), a FireWire interface, an Ethernet interface, an analog-to-digital converter (ADC), a DAC, and so forth.

Figure 3:
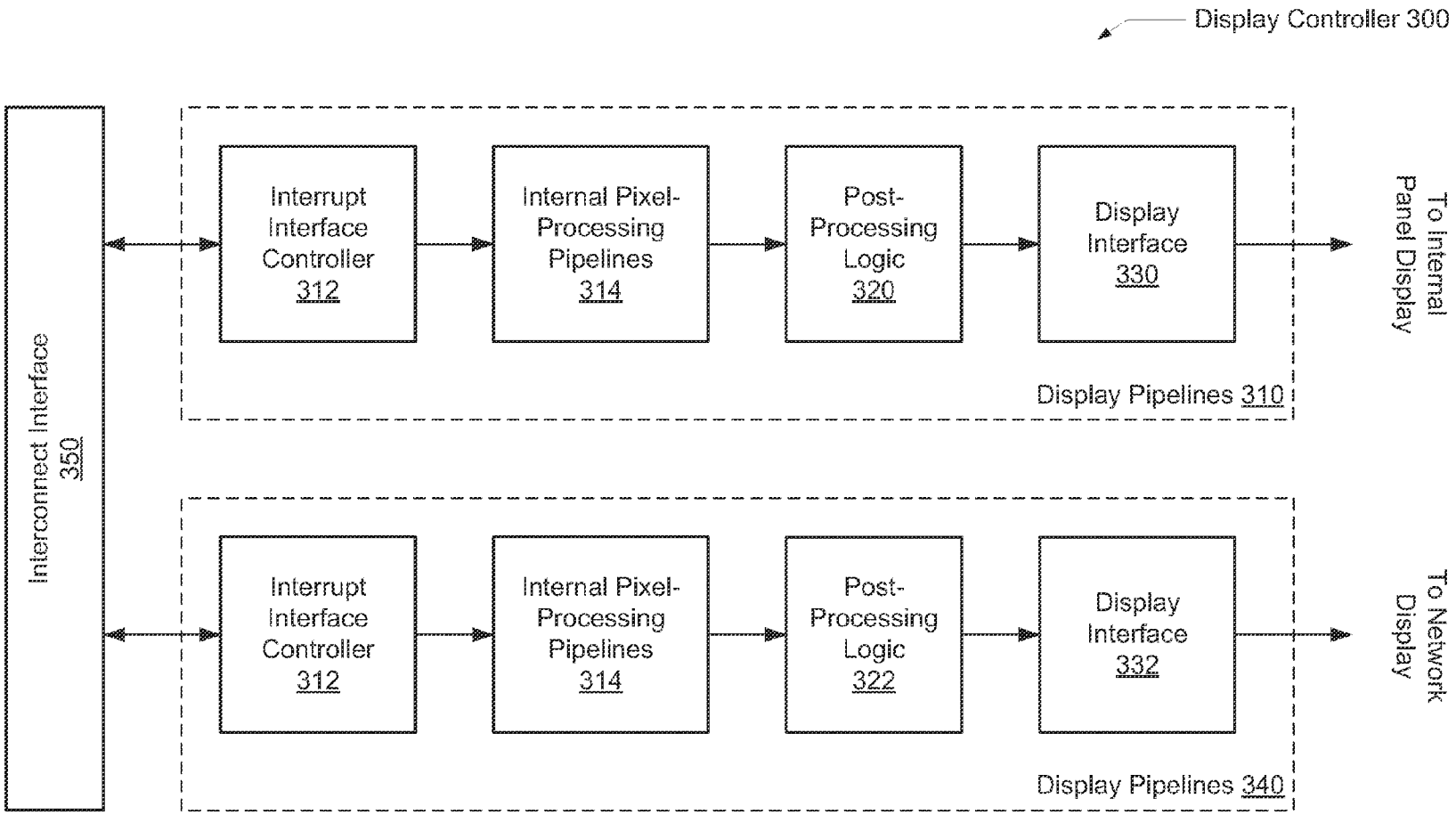
FIG. 3 is a generalized block diagram of a display controller.

Turning now to FIG. 3, a generalized block diagram of one embodiment of a display controller 300 is shown. The display controller 300 includes an interconnect interface 350 and two display pipelines 310 and 340. Although two display pipelines are shown, the display controller 300 may include another number of display pipelines. Each of the display pipelines may be associated with a separate display screen. For example, the display pipeline 310 may send rendered graphical information to an internal display panel. The display pipeline 340 may send rendered graphical information to a network-connected display. Other examples of display screens may also be possible and contemplated.

The interconnect interface 350 may include multiplexers and control logic for routing signals and packets between the display pipelines 310 and 340 and a top-level fabric. Each of the display pipelines may include an interrupt interface controller 312. The interrupt interface controller 312 may include logic to expand a number of sources or external devices to generate interrupts to be presented to the internal pixel-processing pipelines 314. The controller 312 may provide encoding schemes, registers for storing interrupt vector addresses, and control logic for checking, enabling, and acknowledging interrupts. The number of interrupts and a selected protocol may be configurable. In some embodiments, the controller 312 uses the AMBA® AXI (Advanced eXtensible Interface) specification.

Each display pipeline within the display controller 262 may include one or more internal pixel-processing pipelines 314. The internal pixel-processing pipelines 314 may include one or more ARGB (Alpha, Red, Green, Blue) pipelines for processing and displaying user interface (UI) layers. The internal pixel-processing pipelines 314 may include one or more pipelines for processing and displaying video content such as YUV content. In some embodiments, each of the internal pixel-processing pipelines 314 include blending circuitry for blending graphical information before sending the information as output to respective displays.

A layer may refer to a presentation layer. A presentation layer may consist of multiple software components used to define one or more images to present to a user. The UI layer may include components for at least managing visual layouts and styles and organizing browses, searches, and displayed data. The presentation layer may interact with process components for orchestrating user interactions and also with the business or application layer and the data access layer to form an overall solution. However, the internal pixel-processing pipelines 314 handle the UI layer portion of the solution.

The YUV content is a type of video signal that consists of three separate signals. One signal is for luminance or brightness. Two other signals are for chrominance or colors. The YUV content may replace the traditional composite video signal. The MPEG-2 encoding system in the DVD format uses YUV content. The internal pixel-processing pipelines 314 handle the rendering of the YUV content. A further description of the internal pixel-processing pipelines is provided shortly.

In various embodiments, each of the pipelines within the internal pixel-processing pipelines 314 may have request aggregate logic. In other embodiments, the granularity of the request aggregate logic may be less fine and set for each one of the display pipelines 310 and 340.

The display pipeline 310 may include post-processing logic 320. The post-processing logic 320 may be used for color management, ambient-adaptive pixel (AAP) modification, dynamic backlight control (DPB), panel gamma correction, and dither. The display interface 330 may handle the protocol for communicating with the internal panel display. For example, the Mobile Industry Processor Interface (MIPI) Display Serial Interface (DSI) specification may be used. Alternatively, a 4-lane Embedded Display Port (eDP) specification may be used.

The display pipeline 340 may include post-processing logic 322. The post-processing logic 322 may be used for supporting scaling using a 5-tap vertical, 9-tap horizontal, 16-phase filter. The post-processing logic 322 may also support chroma subsampling, dithering, and write back into memory using the ARGB888 (Alpha, Red, Green, Blue) format or the YUV420 format. The display interface 332 may handle the protocol for communicating with the network-connected display. A direct memory access (DMA) interface may be used.

Figure 4:
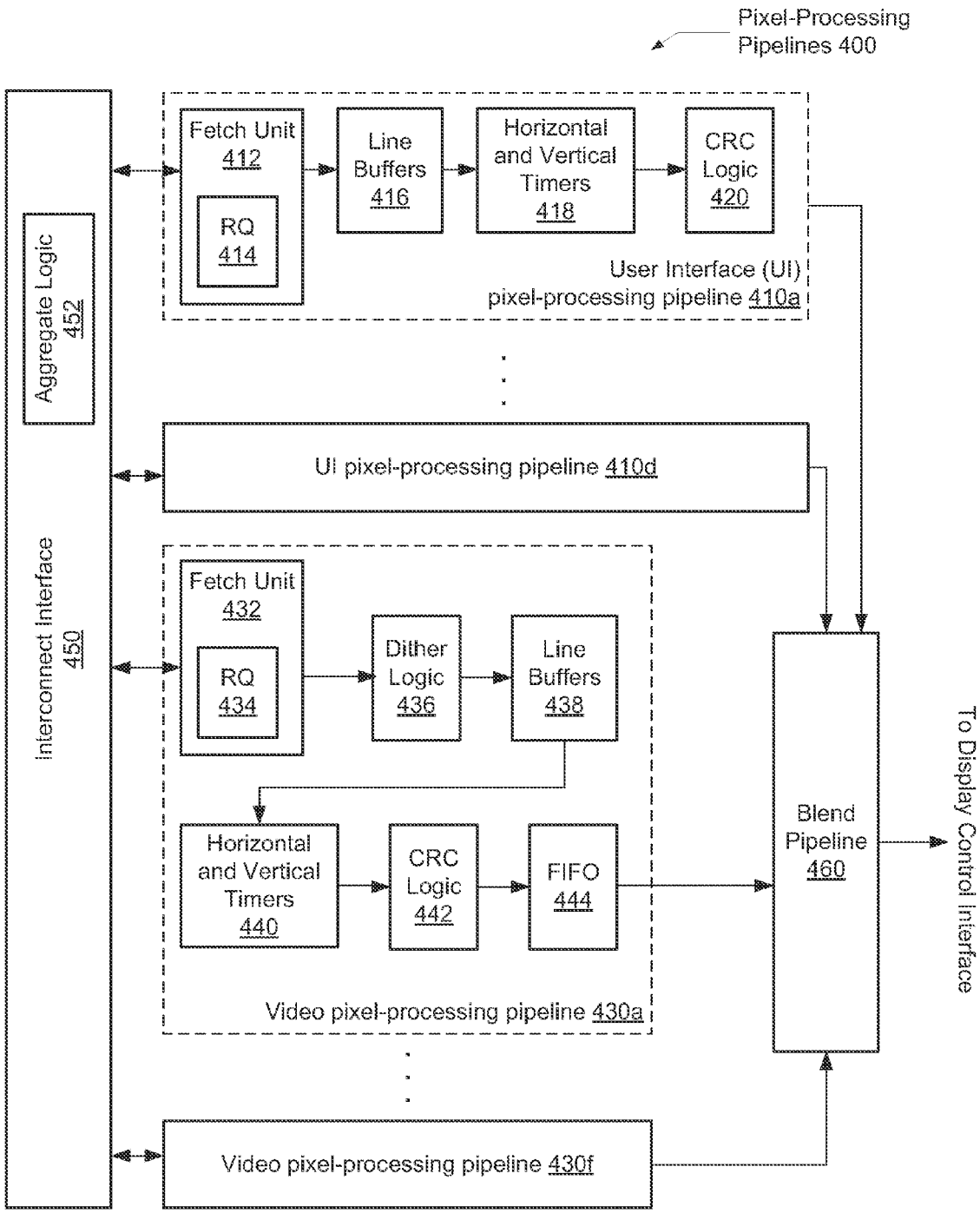
FIG. 4 is a generalized block diagram of pixel-processing pipelines.

Turning now to FIG. 4, a generalized block diagram of one embodiment of the pixel-processing pipelines 400 within the display pipelines is shown. Each of the display pipelines within a display controller may include the pixel-processing pipelines 400. The pipelines 400 may include user interface (UI) pixel-processing pipelines 410*a*-410*d* and video pixel-processing pipelines 430*a*-430*f*.

The interconnect interface 450 may act as a master and a slave interface to other blocks within an associated display pipeline. Read requests may be sent out and incoming data may be received. The outputs of the pipelines 410*a*-410*d* and the pipelines 430*a*-430*f* are sent to the blend pipeline 460.

The blend pipeline 460 may blend the output of a given pixel-processing pipeline with the outputs of other active pixel-processing pipelines.

The UI pipelines 410*a*-410*d* may be used to present one or more images of a user interface to a user. A fetch unit 412 may send out read requests for frame data and receive responses. The read requests may be generated and stored in a request queue (RQ) 414. Alternatively, the request queue 414 may be located in the interface 450. Corresponding response data may be stored in the line buffers 416. A configuration register may be located within the fetch unit 412 or within the interface 450. The configuration register may be programmable and store a threshold. The threshold may be a number of stored requests that is to be reached before a respective pipeline becomes a candidate for request arbitration.

The aggregate logic 422 may monitor the number of stored requests and compare the number to the stored threshold. Alternatively, the aggregate logic 422 may monitor an amount of freed storage space, convert the amount of storage to a number of memory read requests, and compare the number to the stored threshold. In response to determining the number of memory read requests reaches the threshold and an aggregate condition is satisfied, such as a system idle state, then the aggregate logic 422 may submit to an arbiter the respective pipeline as a candidate for submitting requests. Alternatively, the aggregate logic 422 may allow the fetch unit 412 to present memory read requests to the interface 450, which causes the pipeline 410*a* to become a candidate for arbitration. Until a given threshold is reached, the respective pixel-processing pipeline may not send any requests to the memory controller or an indication as a candidate for arbitration to the arbitration logic. The arbiter may be located within the interface 450. The arbiter may also be located outside of the pixel-processing pipelines but within the display pipeline.

When a given one of the pixel-processing pipelines 410*a*-410*d* and 430*a*-430*f* is selected by arbitration logic for sending requests to a memory controller, the aggregate logic 452 may monitor when the associated number of stored requests is exhausted. In addition, if new requests are stored in the request queue during this time, the aggregate logic 452 may allow those requests to be sent as well. The threshold for the number of stored requests may be a relatively large number. Therefore, a respective one of the pipelines 410*a*-410*d* and 430*a*-430*f* may aggregate a relatively large number of memory access requests before becoming a candidate for arbitration. Accordingly, the shared memory may spend longer amounts of time in a low-power mode causing an overall reduction in power consumption.

The line buffers 416 may store the incoming frame data corresponding to row lines of a respective display screen. The horizontal and vertical timers 418 may maintain the pixel pulse counts in the horizontal and vertical dimensions of a corresponding display device. A vertical timer may maintain a line count and provide a current line count to comparators. The vertical timer may also send an indication when an end-of-line (EOL) is reached.

The Cyclic Redundancy Check (CRC) logic block 420 may perform a verification step at the end of the pipeline. The verification step may provide a simple mechanism for verifying the correctness of the video output. This step may be used in a test or a verification mode to determine whether a respective display pipeline is operational without having to attach an external display. A CRC register may be initialized at reset or restart. In some embodiments, the CRC register is a 32-bit register. When enabled, the CRC generation proceeds until the next time a reset or a restart occurs. The CRC register may be read anytime but to insure that the CRC contents are not destroyed from frame-to-frame, a snapshot of the CRC register may be taken whenever there is a restart occurs. The contents of a CRC Snapshot Register may be read while a signature for the next frame is being generated.

Within the video pipelines 430*a*-430*f*, the blocks 432, 434, 438, 440, 442, and 446 may provide functionality corresponding to the descriptions for the blocks 412, 414, 416, 418, 420 and 422 within the UI pipelines. The fetch unit 432 fetches video frame data in various YCbCr formats. Similar to the fetch unit 412, the fetch unit 432 may include a request queue (RQ) 434. The dither logic 436 inserts random noise (dither) into the samples. The timers and logic in block 440 scale the data in both vertical and horizontal directions.

Figure 5:
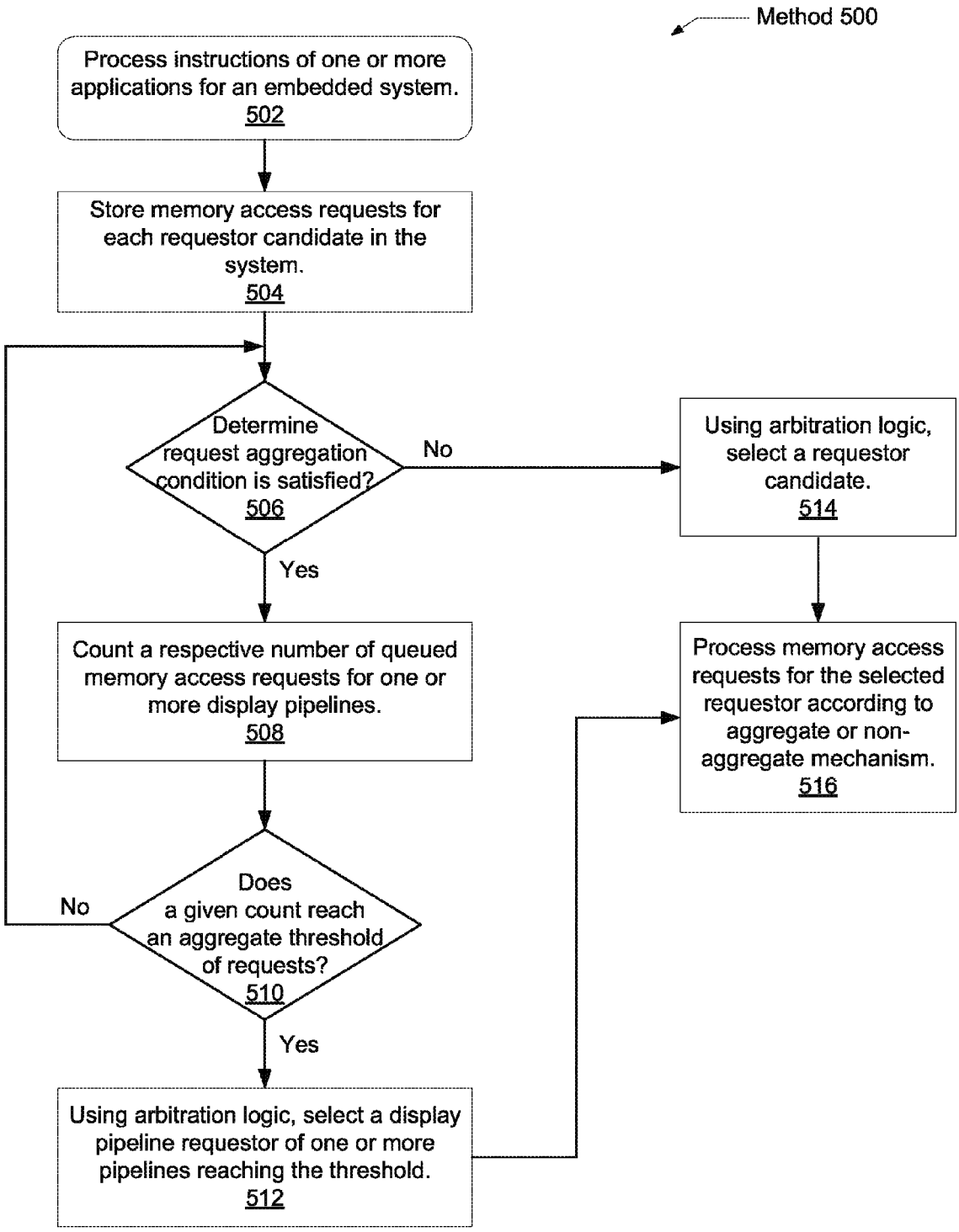
FIG. 5 is a generalized flow diagram of one embodiment of a method for selecting a mechanism to use for processing memory access requests.

Referring now to FIG. 5, a generalized flow diagram of one embodiment of a method 500 for selecting a mechanism to use for processing memory access requests is shown. For purposes of discussion, the steps in this embodiment are shown in sequential order. However, in other embodiments some steps may occur in a different order than shown, some steps may be performed concurrently, some steps may be combined with other steps, and some steps may be absent.

In block 502, instructions of one or more software applications are processed by a computing system. In some embodiments, the computing system is an embedded system. In block 504, memory access requests are stored for each requestor candidate in the system. In one example, memory read requests for multiple display pipelines within a display controller may be stored in respective request queues. In another example, memory read requests for multiple pixel-processing pipelines within a given display pipeline may be stored in respective request queues.

Request aggregation for the stored read requests may not be used unless a request aggregation condition is satisfied. Until the condition is satisfied, the requestor candidates may take part in arbitration. When selected, the requestor may send associated read requests according to a bursting mode or a non-bursting mode. One example of a request aggregation condition is a system idle state whereby the memory subsystem is still being accessed to refresh one or more displays with video frame data. If the request aggregation condition is not satisfied (conditional block 506), then in block 514, arbitration logic selects a given one of multiple requestor candidates.

In block 516, the memory access requests are processed according to a non-aggregate mechanism. For example, a non-bursting mode may be used to send the memory read requests to the memory controller. Alternatively, a bursting mode may be used that allows arbitration to occur again after a number of requests are sent wherein the number equals a programmable burst size. If the request aggregation condition is satisfied (conditional block 506), then in block 508, a respective number of queued memory read requests for one or more requestors is counted. Alternatively, an amount of freed storage space for response data may be monitored and converted to a number of memory read requests. Until the count reaches a threshold, memory read requests may be prevented from being generated or prevented from being sent to a corresponding interface, which alerts arbitration logic. Again, the requestors may be multiple display pipelines within a display controller or may be multiple pixel-processing pipelines within a given display pipeline.

One or more requestors in the system may have a programmable aggregate threshold of the number of stored memory read requests to send to the memory controller. The threshold may be a relatively large number, thereby delaying when memory requests may be sent to the memory controller. In one example, during the system idle state, the large aggregate threshold delays when a display controller sends memory read requests to the memory controller. This appreciable delay allows the memory subsystem to spend a longer duration in a low-power mode.

If a given count of queued memory read requests reaches an aggregate threshold of requests (conditional block 510), then in block 512, arbitration logic selects a requestor of one or more requestors reaching the threshold. For example, two or more display pipelines within the display controller may reach a respective threshold. Alternatively, two or more internal pixel-processing pipelines within a display pipeline may reach a respective threshold. In yet another example, two or more internal pixel-processing pipelines in separate display pipelines may reach a respective threshold. The arbitration logic may select a give one of the qualified requestors for sending memory read requests to the memory controller. The arbitration logic may use a round robin, a least-recently-used, an encoded priority, or another scheme for selecting.

In block 516, the memory access requests are processed according to an aggregate mechanism. For example, the selected requestor may send memory read requests to the memory controller until all stored requests are issued or sent. Due to the satisfied request aggregate condition, no other requestors outside of the display controller may be attempting to access the shared memory. Therefore, whether a non-burst mode or a burst mode is used, the selected requestor may send all of its stored requests to the memory controller. If two or more requestors within the display controller have reached aggregate thresholds for the number of stored memory read requests, then granted memory access may alternate between these requestors.

Figure 6:
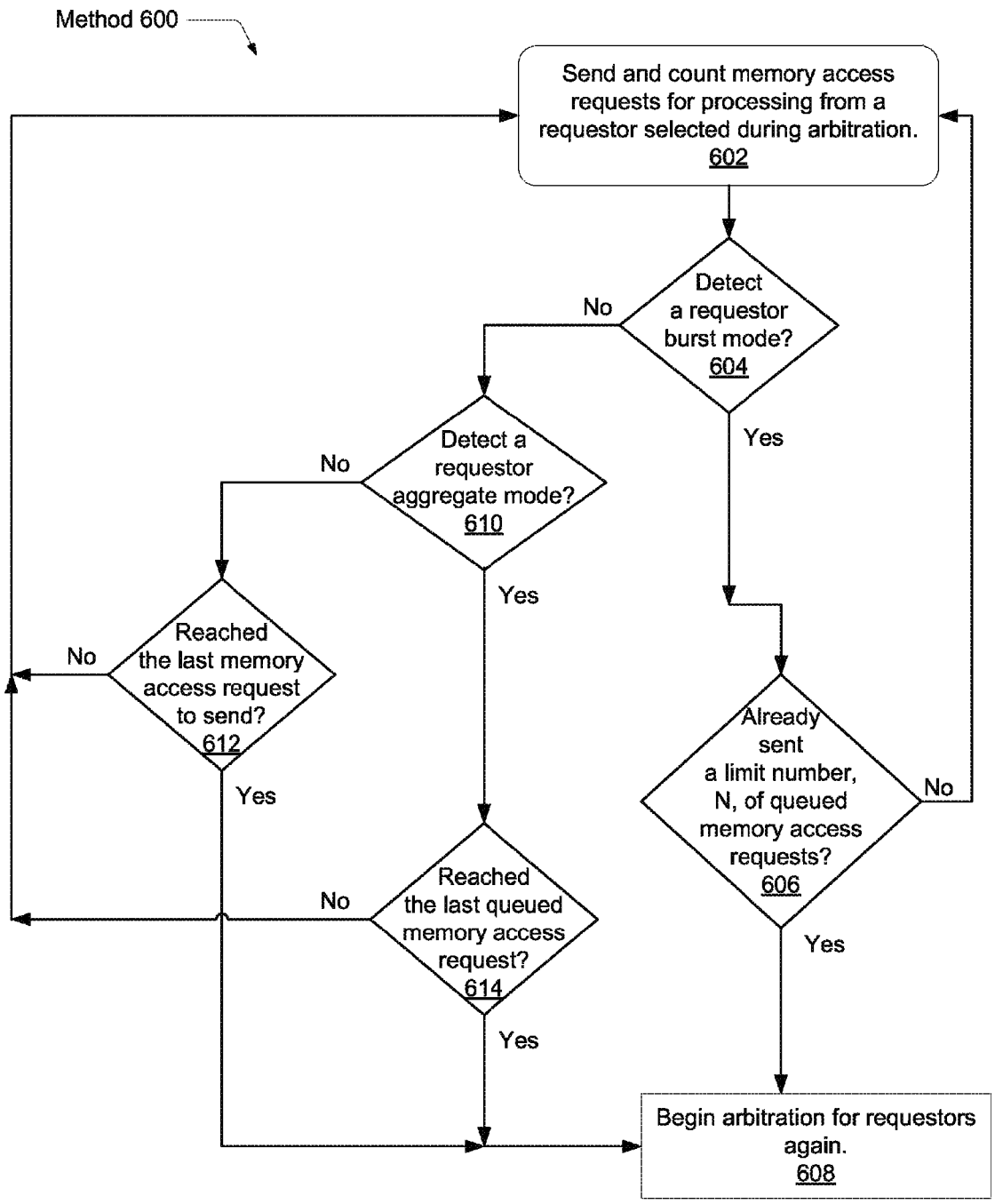
FIG. 6 is a generalized flow diagram of one embodiment of a method for processing memory access requests.

Referring now to FIG. 6, a generalized flow diagram of one embodiment of a method 600 for processing memory access requests is shown. For purposes of discussion, the steps in this embodiment are shown in sequential order. However, in other embodiments some steps may occur in a different order than shown, some steps may be performed concurrently, some steps may be combined with other steps, and some steps may be absent.

In block 602, memory access requests are sent from a requestor selected during arbitration. A number of memory read requests that are sent may be counted. In various embodiments, the selected requestor is a given one of multiple display pipelines within the display controller. In other embodiments, the selected requestor is a given one of multiple internal pixel-processing pipelines within a display pipeline. A request aggregate mode may be used. A requestor aggregate mode may be used if earlier the request aggregate condition is satisfied. An additional burst mode may be used with the request aggregate mode. Otherwise, a non-burst mode may be used.

If the burst mode is detected for sending memory read requests (conditional block 604), then the selected requestor sends a limited number of memory read requests to the memory controller without interruption for arbitration. The limited number of memory read requests to send uninterrupted may be equal to a programmable burst size. Arbitration may not occur while the selected requestor sends the memory read requests prior to reaching the limit. In this case, the steps taken in blocks 602-606 may occur whether or not the request aggregate mode is selected. If the request aggregate mode is on, then the start of sending memory read requests is further delayed. However, afterward, the same steps may be taken when in burst mode.

If the selected requestor has not reached the burst size limit of the number of memory read requests to send (conditional block 606), then control flow of method 600 returns to block 602. If the selected requestor has reached the burst size limit of the number of memory read requests to send (conditional block 606), then in block 608, arbitration may be performed again.

If the burst mode is not detected for sending memory read requests (conditional block 604), and the requestor aggregate mode is also not detected (conditional block 610), then arbitration may occur at any time as the selected requestor sends memory read requests to the memory controller. The most-recent memory read request sent might be the last request to send before arbitration logic detects two or more requestors are now candidates for sending requests and selects one of these requestors. Alternatively, the arbitration logic may not detect another requestor as a candidate for sending requests before the presently selected requestor finishes sending all of its stored memory read requests. If the presently selected requestor has reached its last memory read request to send to the memory controller (conditional block 612), then control flow of method 600 moves to block 608. Otherwise, control flow of method 600 returns to block 602.

If the burst mode is not detected for sending memory read requests (conditional block 604), and the requestor aggregate mode is detected (conditional block 610), then, again, arbitration may occur at any time as the selected requestor sends memory read requests to the memory controller. However, now the requestor aggregate mode is satisfied and there is a high chance the arbitration process won't begin for a long duration of time. The system may be in an idle state. There may be a high percentage chance that the arbitration logic does not detect another requestor as a candidate for sending requests before the presently selected requestor finishes sending all of its stored memory read requests.

If the presently selected requestor has reached its last queued memory read request to send to the memory controller (conditional block 614), then control flow of method 600 moves to block 608. Otherwise, control flow of method 600 returns to block 602.

In various embodiments, an initial value may be set for the aggregate threshold used to determine a number of memory read requests to store before a particular requestor is permitted to participate in arbitration. The initial threshold may be written into a configuration register by software, such as a device driver for the display controller. The configuration register may be read by hardware circuitry within the display controller for determining whether the particular requestor is now a candidate for arbitration. The threshold may be changed as applications execute on the computing system, such as an embedded system. By changing the aggregate threshold, the number of requests to send within a burst mode, and the qualifications for creating a satisfied requestor aggregate condition, the system may make adjustments to balance system performance or system power consumption.

The device driver for the display controller may include both user-mode components and kernel-mode components. A graphics hardware vendor may supply the user-mode graphics driver and the kernel-mode graphics driver. The operation system (OS) may load a separate copy of the user-mode driver for each application. The user-mode graphics driver may be a dynamic-link library (DLL) that is loaded by corresponding application programming interfaces (APIs) in the OS graphics APIs. Alternatively, runtime code may be used to install the user-mode graphics driver.

In various embodiments, corresponding graphics libraries and drivers may determine and pass the aggregate threshold from the software application to the computing system, such as to a programmable configuration register within the display controller. In some cases, the user-mode graphics driver may be an extension to the Direct3D and OpenGL software development kits (SDKs). Accordingly, the determination and passing of the aggregate threshold may be made available through a standard interface.

In some embodiments, one or more counters may be used to measure the time duration between separate requestors being selected by arbitration logic and sending an initial memory read request. Additionally, the time duration between a same requestor being selected by arbitration logic during a requestor aggregate mode and sending an initial memory read request may be measured. The recorded times may be compared to given values, such as expected signatures, in order to debug the system and make adjustments to the programmable aggregate threshold and the number of requests to send within a burst mode.

In various embodiments, program instructions of a software application may be used to implement the methods and/or mechanisms previously described. The program instructions may describe the behavior of hardware in a high-level programming language, such as C. Alternatively, a hardware design language (HDL) may be used, such as Verilog. The program instructions may be stored on a computer readable storage medium. Numerous types of storage media are available. The storage medium may be accessible by a computer during use to provide the program instructions and accompanying data to the computer for program execution. In some embodiments, a synthesis tool reads the program instructions in order to produce a netlist comprising a list of gates from a synthesis library.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed is:

1. An apparatus comprising:

a memory controller configured to control access to a shared memory; and a display controller comprising one or more display pipelines configured to read frame data stored in the shared memory for an image to be presented on a display, wherein in response to determining an aggregate condition is satisfied, the display controller is configured to aggregate a first number of memory requests for a given display pipeline of the one or more display pipelines prior to attempting to send any memory requests from the given display pipeline to the memory controller.

2. The apparatus as recited in claim 1, wherein to determine the aggregate condition is satisfied, the display controller is further configured to detect an idle display for each one of the display pipelines that are active.

3. The apparatus as recited in claim 2, wherein the apparatus further comprises a plurality of functional blocks configured to access data stored in the shared memory, wherein to determine the aggregate condition is satisfied, the memory controller is further configured to detect no accesses from the plurality of functional blocks.

4. The apparatus as recited in claim 3, wherein in response to determining the aggregate condition is satisfied and receiving no accesses from the one or more display pipelines, the memory controller is further configured to transition to a low-power mode.

5. The apparatus as recited in claim 4, wherein as the given display pipeline is sending memory requests to the memory controller after aggregating the first number of memory requests, arbitration is performed between at least two active requestors among the plurality of functional blocks and the one or more display pipelines.

6. The apparatus as recited in claim 5, wherein in response to detecting a burst mode, no arbitration is performed while the given display pipeline sends a second number of memory requests equal to a burst size to the memory controller.

7. The apparatus as recited in claim 5, wherein the first number of memory requests to aggregate is programmable.

8. The apparatus as recited in claim 7, wherein the apparatus further comprises counters configured to measure and collect time durations between initial memory requests sent from selected active requestors to the memory controller, wherein the first number of memory requests to aggregate is programmed based at least on the collected time durations.

9. The apparatus as recited in claim 5, wherein at least one of the one or more display pipelines comprises a plurality of internal pixel-processing pipelines, each is configured to send memory requests to the memory controller.

10. The apparatus as recited in claim 9, wherein the plurality of the internal pixel-processing comprises at least one of the following: a user interface (UI) pipeline and a video pipeline.

11. The apparatus as recited in claim 10, wherein the apparatus is a system-on-a-chip (SOC).

12. A method comprising:

controlling access to a shared memory via a memory controller;

reading frame data stored in the shared memory for an image to be presented on a display; and in response to determining an aggregate condition is satisfied, aggregating a first number of memory requests for a given display pipeline of one or more display pipelines prior to attempting to send any memory requests from the given display pipeline to the memory controller.

13. The method as recited in claim 12, wherein to determine the aggregate condition is satisfied, the method further comprises detecting an idle display for each one of the display pipelines that are active.

14. The method as recited in claim 13, wherein in response to determining the aggregate condition is satisfied and receiving no accesses from the one or more display pipelines, the method further comprises transitioning the memory controller to a low-power mode.

15. The method as recited in claim 14, wherein in response to detecting a burst mode, the method further comprises preventing arbitration from being performed while the given display pipeline sends a second number of memory requests equal to a burst size to the memory controller.

16. The method as recited in claim 14, wherein the method further comprises measuring and collecting time durations between initial memory requests sent from selected active requestors to the memory controller, wherein the first number of memory requests is programmed based at least on the collected time durations.

17. The method as recited in claim 12, wherein to determine the aggregate condition is satisfied, the method further comprises detecting no accesses to the memory controller from a plurality of functional blocks configured to access data stored in the shared memory.

18. The method as recited in claim 17, wherein as the given display pipeline is sending memory requests to the memory controller after aggregating the first number of memory requests, the method further comprises performing arbitration between at least two active requestors among the plurality of functional blocks and the one or more display pipelines.

19. A display controller comprising:

an interface configured to receive frame data for an image to be presented on a given one of one or more displays;

one or more display pipelines, each configured to process the received frame data for a respective one of the one or more displays; and control logic comprising circuitry, wherein in response to determining an aggregate condition is satisfied, the control logic is configured to aggregate a first number of memory requests for a given display pipeline of the one or more display pipelines prior to attempting to send any memory requests from the given display pipeline to an external memory controller configured to control access to a shared memory.

20. The display controller as recited in claim 19, wherein to determine the aggregate condition is satisfied, the control logic is further configured to detect an idle display for each one of the display pipelines that are active.

21. The display controller as recited in claim 20, wherein the display controller further comprises counters configured to measure and collect time durations between initial memory requests sent from the one or more display pipelines, wherein the first number of memory requests to aggregate is programmed based at least on the collected time durations.

22. The display controller as recited in claim 20, wherein at least one of the one or more display pipelines comprises a plurality of internal pixel-processing pipelines, each comprising at least one of the following: a user interface (UI) pipeline and a video pipeline.

23. The display controller as recited in claim 19, wherein to determine the aggregate condition is satisfied, the control logic is further configured to receive an indication the memory controller detects no accesses from a plurality of functional blocks configured to access data stored in the shared memory.

24. A non-transitory computer readable storage medium comprising program instructions operable to efficiently schedule memory requests in a computing system, wherein the program instructions are executable by a processor to:

control access to a shared memory via a memory controller;

read frame data stored in the shared memory for an image to be presented on a given one of one or more displays; and in response to determining an aggregate condition is satisfied, aggregate a first number of memory requests for a given display pipeline of one or more display pipelines prior to attempting to send any memory requests from the given display pipeline to the memory controller.

25. The storage medium as recited in claim 24, wherein to determine the aggregate condition is satisfied, the program instructions are further executable to detect an idle display for each one of the display pipelines that are active.

26. The storage medium as recited in claim 25, wherein program instructions are further executable to measure and collect time durations between initial memory requests sent from the one or more display pipelines to the memory controller, wherein the first number of memory requests to aggregate is programmed based on the collected time durations.

27. The storage medium as recited in claim 24, wherein in response to determining the aggregate condition is satisfied and the memory controller receives no accesses from the one or more display pipelines, the program instructions are further executable to transition the memory controller to a low-power mode.

* * * * *